US008425288B1

(12) United States Patent
Snipes, Jr.

(10) Patent No.: US 8,425,288 B1
(45) Date of Patent: Apr. 23, 2013

(54) FOUNDATION VENT ASSEMBLY

(76) Inventor: Keith Wayne Snipes, Jr., Dunn, NC (US)

( * ) Notice: Subject to any disclaimer, the term of this patent is extended or adjusted under 35 U.S.C. 154(b) by 1598 days.

(21) Appl. No.: 11/866,141

(22) Filed: Oct. 2, 2007

(51) Int. Cl.

| | |
|---|---|
| ***F24F 7/00*** | (2006.01) |
| ***E04B 1/70*** | (2006.01) |
| ***E04B 7/00*** | (2006.01) |
| ***E04B 1/12*** | (2006.01) |

(52) U.S. Cl.
USPC ..... 454/271; 52/302.1; 52/276; 52/568

(58) Field of Classification Search ..... 454/271
See application file for complete search history.

(56) References Cited

U.S. PATENT DOCUMENTS 4,916,875 A * 4/1990 Kashiwagi ..... 52/302.3
6,302,785 B1 * 10/2001 McKinney et al. ..... 454/334
7,730,684 B1 * 6/2010 Keene ..... 52/302.4
7,877,946 B1 * 2/2011 Stepanek ..... 52/302.3
2009/0239462 A1 * 9/2009 Hendricks ..... 454/271

* cited by examiner

*Primary Examiner* — Steven B McAllister
*Assistant Examiner* — Helena Kosanovic

(57) ABSTRACT

A foundation vent assembly for a masonry foundation wall includes a metal frame mounted in an opening registering with a crawl space area. The frame orients and supports a series of spaced vertical grill blocks matching the foundation masonry and integrated with the surrounding mortar joints, thereby providing a continuous appealing exterior appearance. The spaces between the grill blocks register with ventilation slots in the rear of the frame. The ventilations slots are covered by a screen mesh to prevent pest infiltration, and optionally covered with a pivoting damper for selective opening and closing, having a rear wall covering the opening with spaced screen vents. The grill blocks are aligned by tabs on upper and lower flange walls between the vents and provide for extension of the foundation mortar joints thereby providing a consistent overall façade.

11 Claims, 6 Drawing Sheets

FOUNDATION VENT ASSEMBLY

FIELD OF THE INVENTION

The present invention relates to ventilation of enclosed spaces beneath buildings and, in particular, to a vent assembly for the crawl spaces of brick faced foundations.

BACKGROUND OF THE INVENTION

Ventilation is provided in the enclosed crawl space beneath a building to prevent accumulation of moisture and resultant degradation of the structural elements. In providing such protection, it is also necessary to prevent the entry of unwanted animals and insects. Accordingly, various screen coverings have been provided on the foundation that allow air circulation in the crawl space while preventing the entry of undesired species. It is also common for the foundation vents to include a closable member for blocking circulation during lower moisture periods when protection is not needed and raise the crawl space temperature for reducing heating costs during the colder seasons.

For residential use, plastic and metal vent assemblies with dampers and/or shutters are commonly used. While functioning satisfactorily for ventilation and pest protection, their appearance is unappealing and particularly detracts from the aesthetics of masonry faced buildings and foundations. Further, the vent assemblies are made from light weight materials prone to damage from impact and environmental conditions. The closures may also bind during the setting of the mortar, making opening and closing difficult.

SUMMARY OF THE INVENTION

This present invention provides a foundation vent assembly for use on masonry faced foundations that provides an appealing exterior consistent with the brick, stone, block and other masonry façades. The vent assembly installs with tools and methods common to masonry, resists accidental and environmental damage while securing and ventilating the crawl space.

The foundation vent assembly of the invention comprises a rugged metal support frame that orients and supports a series of spaced vertical soldiers or grill blocks, the same as on the building veneer, and integrates with the surrounding mortar joints, thereby providing a continuous appealing exterior appearance. The spaces between the blocks register with ventilation slots in the rear of the frame. The ventilations slots are covered by a screen mesh to prevent pest infiltration, and optionally covered with a pivoting damper for selective opening and closing. The blocks effectively prevent damage to the ventilation paths.

The support frame includes an upper flange or lintel and a lower flange or sill. The sill includes upwardly projecting tabs that support the lower surface of the grill bricks. The lintel includes pairs of spaced transverse tabs that slidably support the upper ends of the grill blocks whereby the grill blocks are affirmatively located in parallel spaced relation forming a grill with openings registering with the ventilation slots. The lintel also supports the upper course of bricks avoiding direct loading on the grill bricks.

The support frame is mounted at a conventional preliminary opening defined by a lower course of masonry and spaced side courses providing an upwardly opening rectangular slot. For installation, the support frame is lowered into the opening with the sill resting on the lower course, the sides of the rear plate overlapping the side courses and the lintel resting on the upper corners of the side courses. Mortar is then applied to the sill, with the lower tabs aligning the lower ends of the grill blocks with the lower surfaces of the adjacent lower course of side blocks. The grill blocks are installed and the mortar finished and pointed to establish a continuous lower mortar joint. Thereafter, an upper course of bricks is laid across the frame lentil and the upper mortar joint finished to complete the installation. The resulting vent assembly blends with the surrounding masonry work providing a visual continuity and a durable construction resisting damage.

Accordingly, it is an object of the invention to provide a vent assembly for use on masonry foundations that is visually attractive.

Another object is to provide a vent assembly for masonry faced crawl spaces that is rugged and easy to install.

A further object is to provide a vent assembly that can be finished in a facing of choice.

BRIEF DESCRIPTION OF THE DRAWINGS

The above and other advantages of the present invention will become apparent upon reading the following written description taken in conjunction with the accompanying drawings in which.

DETAILED DESCRIPTION OF THE PREFERRED EMBODIMENTS

Figure 1:
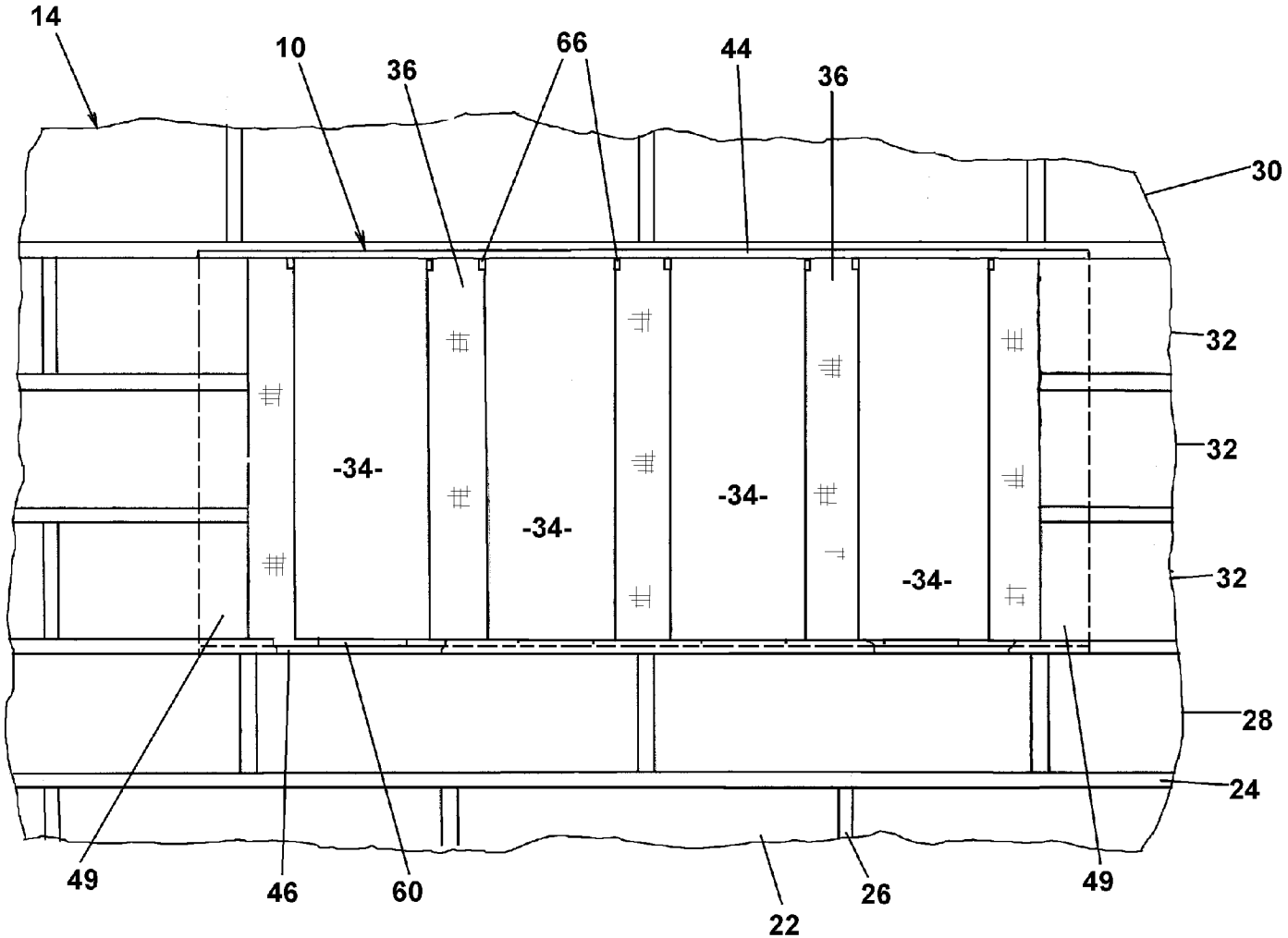
FIG. 1 is a front view of a foundation vent assembly on a perimeter wall in accordance with an embodiment.

Referring to FIG. 1, there is shown a foundation vent assembly 10 according to the invention positioned in an opening in a brick perimeter foundation wall 14 of a structure, residential or commercial. The foundation wall 14 may be backed by cement block, concrete or support piers, and the vent assembly 10 registers with a crawl space 16 (FIG. 3) beneath the lower floor of the building to control ventilation in the enclosed space and prevent ingress by insect or animal pests. The vent assembly according to an embodiment may have a closure system that limits or blocks ventilation to maintain a higher than ambient temperature during the colder seasons.

The foundation wall 14 comprises parallel courses of a masonry block elements such as bricks 22 and will be described with reference thereto. It will be appreciated that other materials such as stone or cement block may be used. The bricks are laid in a running bond pattern, wherein the bricks are separated and interconnected by horizontal mortar joints 24 and vertical mortar joints 26. The foundation opening has a rectangular cross section and is defined by the inwardly facing surfaces of a lower course 28, an upper course 30 and side courses 32. the bricks define an opening of rectangular cross section. As described below, the vent assembly 10 is incorporated into the wall during the laying of the bricks. In assembly, the vent assembly 10 includes vertical soldiers, blocks or grill bricks 34 periodically longitudinally spaced and defining therebetween vent slots 36 communicating the exterior with the crawl space 16.

Figure 2:
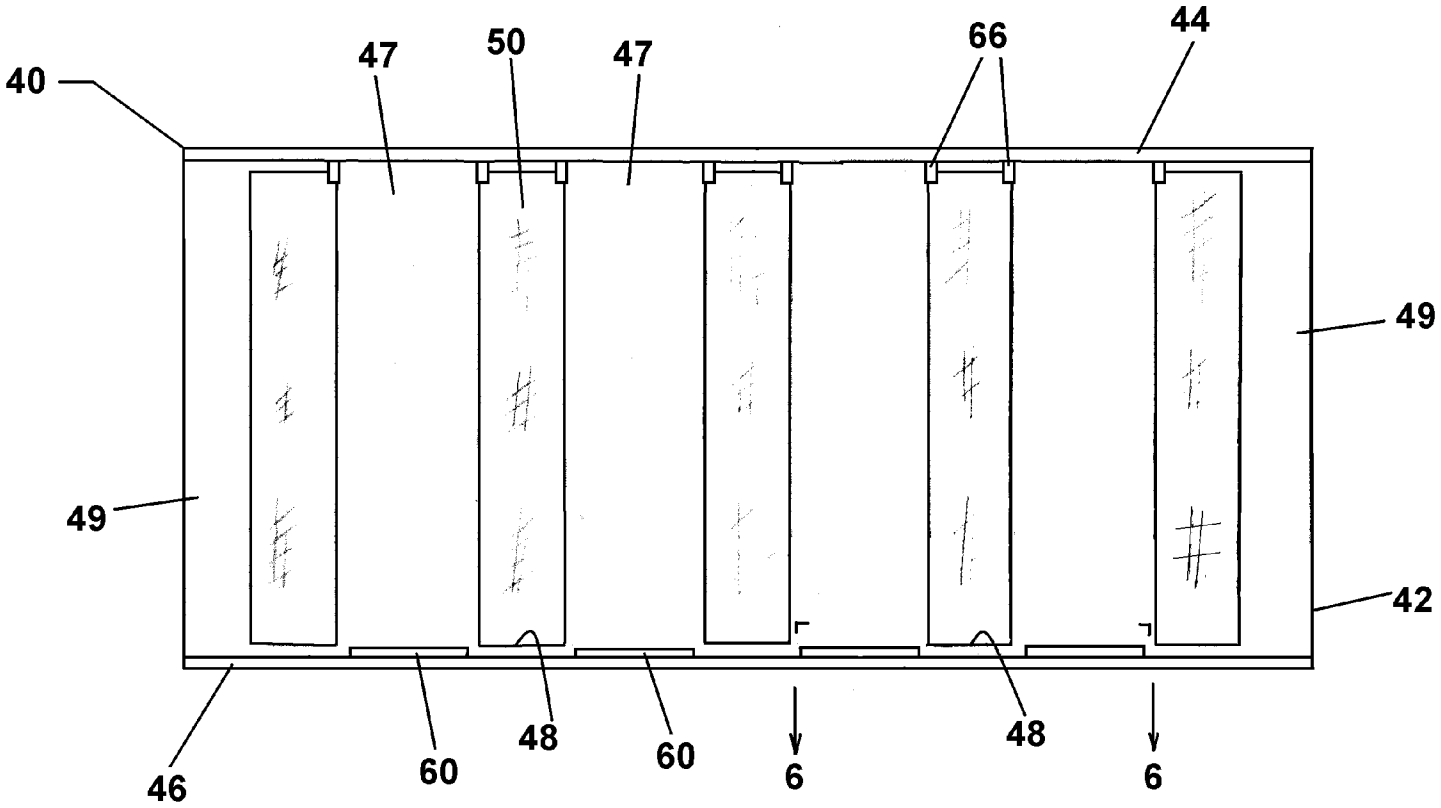
FIG. 2 is a front view of the brick support for the vent assembly of FIG. 1.
Figure 3:
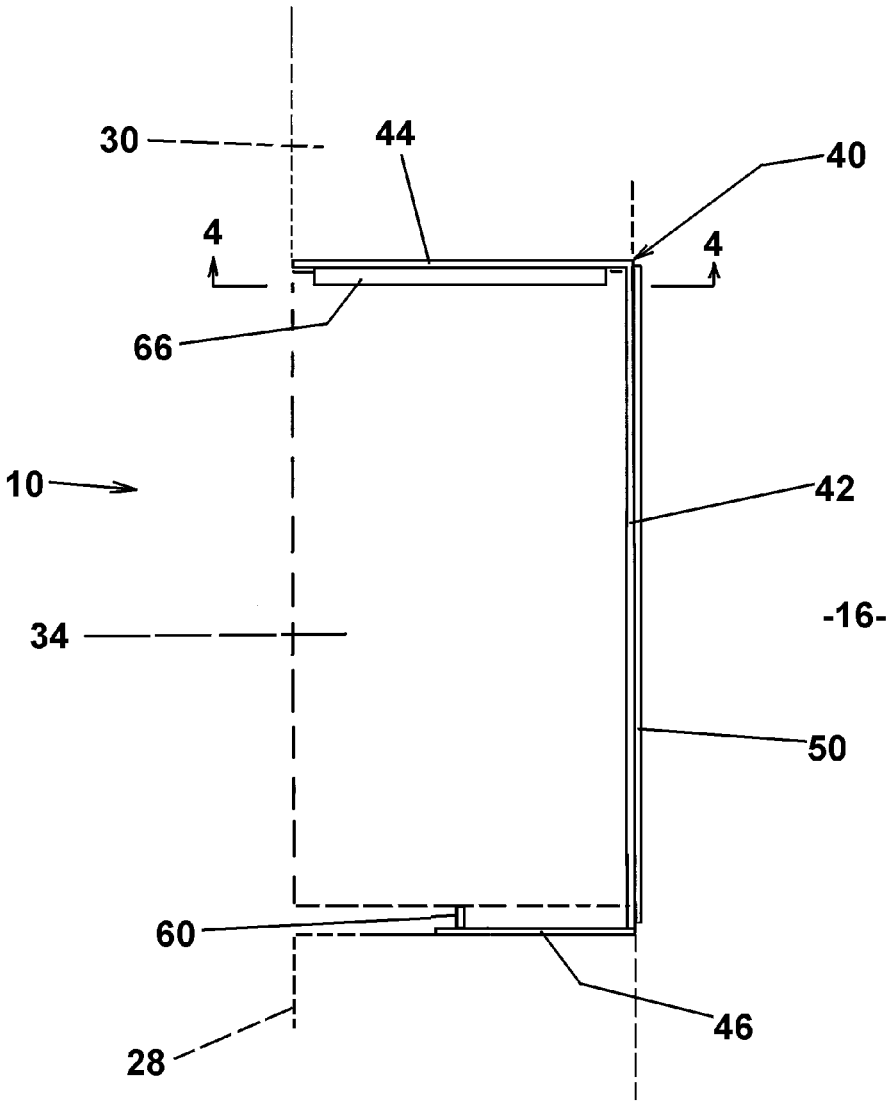
FIG. 3 is a side view of the support frame for the vent assembly.
Figure 8:
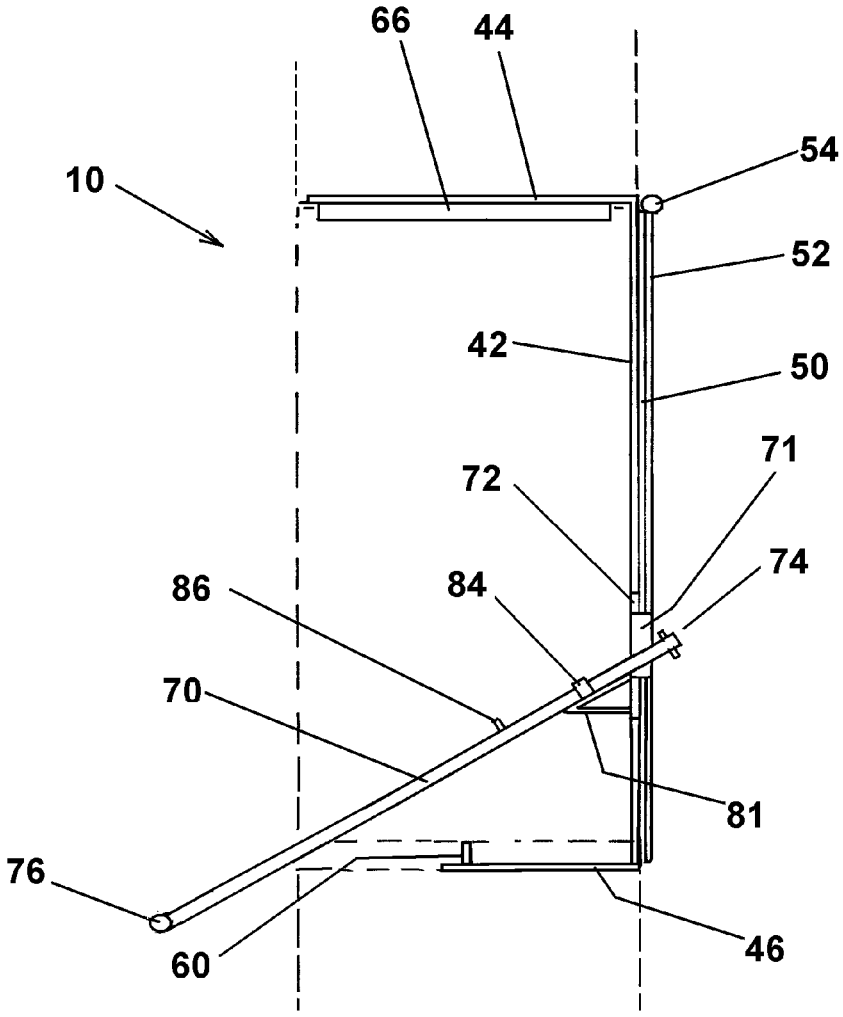
FIG. 8 is side cross sectional view of an embodiment of the foundation vent assembly with the damper in the closed position.
Figure 9:
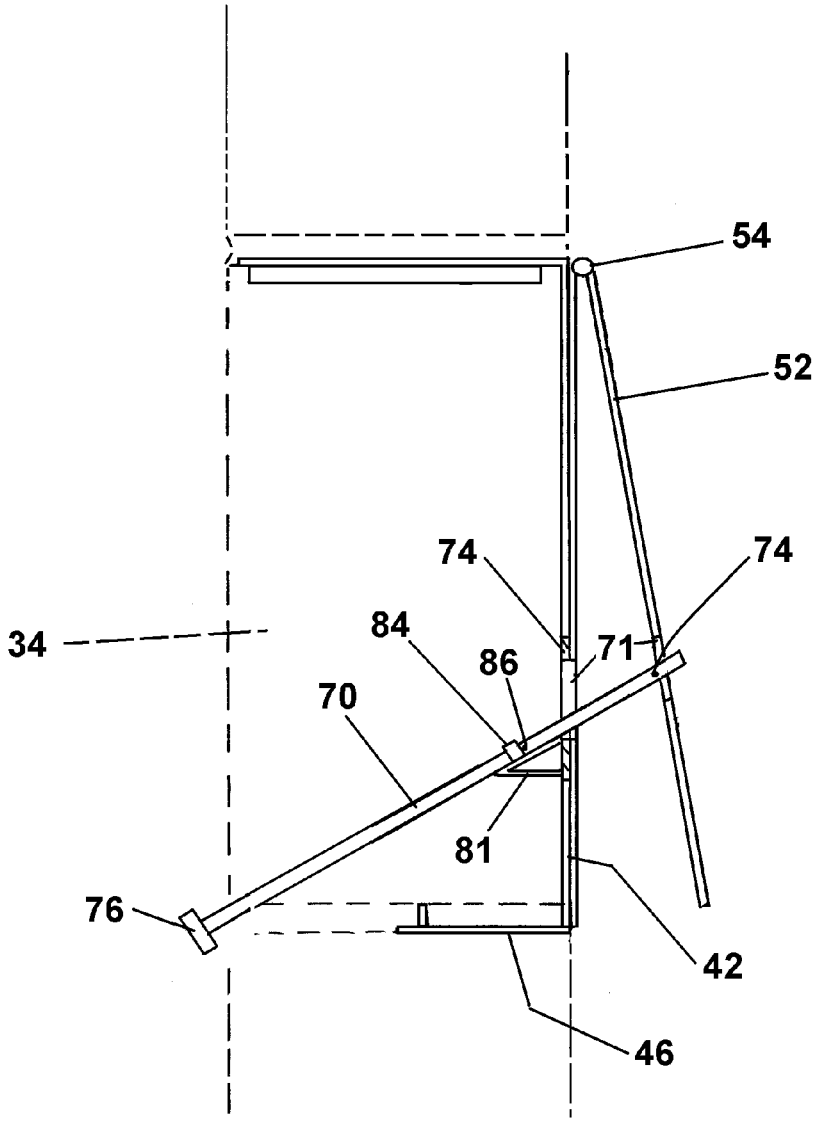
FIG. 9 is a side cross section view of the vent assembly of FIG. 8 with the damper in the open position.

Referring additionally to FIGS. 2 and 3, the vent assembly 10 comprises a support frame 40 carrying the grill bricks 28. The support frame 40 is formed as a single piece or in welded or assembled components of thick gage metal. Other materials such as plastics or metallic materials may be used. The frame 40 includes a vertical rectangular rear or grill wall 42, a horizontal outwardly extending rectangular top flange, wall or lentil 44, and a horizontal outwardly extending rectangular bottom flange, wall or sill 46. The rear wall 42 includes longitudinally spaced vertical grill bars 47 separated by rectangular openings 48 registering in assembly with the vent slots 36. End sections 49 extend outwardly from the outer opening 48. A fine meshed screen 50 is attached to the inner or rear surfaces of the rear wall 42 thereby covering the openings and preventing the entry of insect or animal pests while admitting ventilation in the open condition to the crawl space. If desired, only a single opening for the screen may be provided. As shown in the embodiments of FIGS. 8 and 9, a rectangular damper 52 is pivotally attached at an upper end to the top of the support frame 40 by a hinge member 54 for movement between a closed position (FIG. 8) covering the screen 50 thereby preventing air circulation through the openings 48 and an upwardly and inwardly rotated open position (FIG. 9) admitting ambient ventilation to the crawl space. The frame 40 has a width larger than the opening and a height slightly less than the opening.

Figure 6:
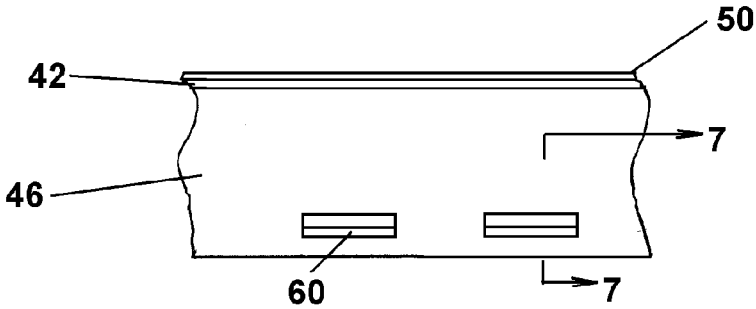
FIG. 6 is an enlarged fragmentary view taken along line 6-6 of FIG. 2.
Figure 7:
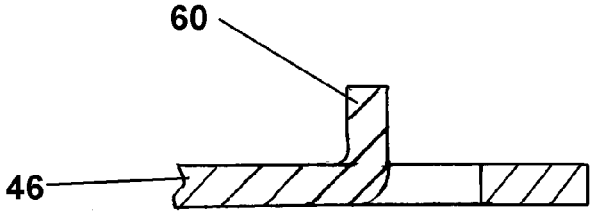
FIG. 7 is an enlarged fragmentary view taken along line 7-7 of FIG. 6.

Referring to FIGS. 6 and 7, the lower wall 46 has a transverse width smaller than the width of the bricks for providing in assembly a full lower mortar joint at the bottom of the vent assembly 10. The lower wall 46 includes upwardly turned tabs 60 presenting projecting surfaces that engage the lower surfaces of the grill bricks 34 to establish a lower position the same as the horizontally adjacent bricks in the foundation course. The tabs 60 may be varyingly oriented and multiple tabs may be provided at each grill brick, but one tab positioned longitudinally at the bottom center has been found to be satisfactory.

Figure 4:
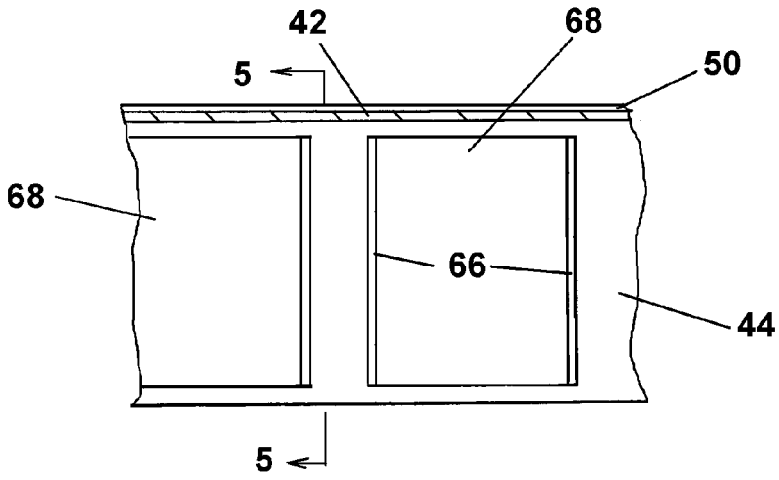
FIG. 4 is an enlarged fragmentary view taken along line 4-4 of FIG. 3.
Figure 5:
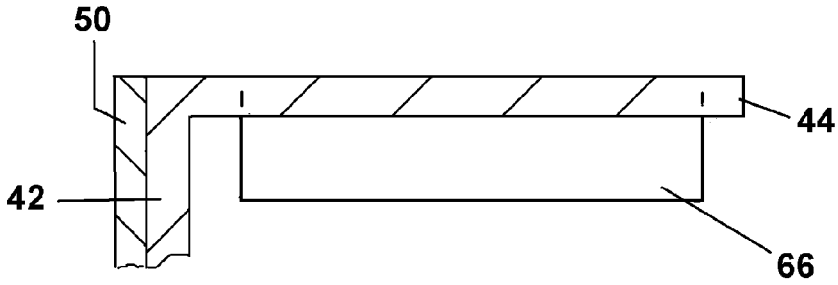
FIG. 5 is an enlarged fragmentary view taken along line 5-5 of FIG. 4.

Referring to FIGS. 4 and 5, the upper wall 44 includes pairs of downwardly turned transverse tabs 66 spaced longitudinally and having projecting surfaces to slidably support and align the upper ends of the grill bricks 34 in assembly. The tabs 66 may be formed individually, or as shown as the lateral edges of an aperture 68. The aperture 68 provides direct contact between the grill brick and the mortar joint for improved structural integrity. The aperture may be sized to allow the grill brick to be vertically lowered into position on the frame or be an outwardly opening slot allowing the grill bricks 48 to be transversely inserted without vertical limitation. The rear wall may be flush with the rear surfaces of the grill bricks or spaced rearwardly thereof to accommodate the desired insertion and alignment.

The above tabs are preferably stamped, however, it will be appreciated that other projecting surfaces may be used for orienting the grill bricks such as swaged dimples, individual posts assembled to the flanges, separately adhered or welded projections, and the like.

Referring to FIGS. 8 and 9, the damper 52 is provided with a closure system for movement between the open and closed positions. While many suitable mechanisms will be apparent, the present closure system comprises an actuating arm 70 having an inner end that projects through an elongated hole 71 in a center cross bar 72 extending across the center slot and through registering holes in the screen and damper. An inner cross pin 74 is provided on the inner end of the arm 70 and an outer cross pin 76 is provided on the outer end of the arm. The damper 52 includes a central opening through which the pin 74 and rod 70 may project. A triangular bracket 81 is attached to the crossbar 72 and carries a retaining clip 84. In the open position, a stop pin 86 on the arm 70 engages the retaining clip 84 to maintain the open position. For actuation, the arm 70 is rotated such that the inner cross pin 74 engages the inner surface of the damper 52 as the arm 70 is inserted inwardly to pivot the damper 52. Thereafter, the arm 70 is lowered into the clip 84, with the stop pin 86 maintaining the open position. The outer end of the arm 70 is locked on the retaining clip 84 to maintain the open position. The damper is closed by reversing the foregoing. In the closed position, the actuating arm 70 is withdrawn and inserted through a hole above the bracket and the outer end stowed at the base of the center slot between the grill bricks. Powered actuators, such as thermal or solar actuated devices, may be used rather than manually actuated devices.

For installation, the lower and side brick courses 28, 32 are laid to form the sill and jams of the foundation opening. The frame 40 is lowered into the opening with the bottom wall 46 engaging the lower course 28 and the end sections 49 of the frame 40 overlapping the rear surfaces of the bricks at the sides courses 32 of the opening. Mortar or adhesive may be applied at the interface for sealing purposes. The outer ends of the top wall of the frame rests on the top inner corner of the side bricks. Thereafter, bed of mortar is applied to the bottom wall 46 of the frame 40 and the grill bricks 34 inserted, supported at the bottom on the tabs 60 of the lower wall 46 and transversely aligned and supported by the tabs 66 on the upper wall 44. The lower mortar joint is pointed. Mortar is then applied to the upper wall 44 and the upper course 30 completed to thereby securely mount the vent assembly on the brick facing.

It will be appreciated that the resultant foundation vent assembly fulfills the objective providing a unit aesthetically compatible with the surrounding brickwork installed with available masonry tools and resistant to impact or environmental damage and that the vertical bricks eliminates the need for a brick lintel. The construction may also be used for vent replacement. The vent assembly in a narrower version can be used to provide weep holes in the masonry veneer.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the spirit and scope of the present invention. The disclosures and description herein are intended to be illustrative and are not in any sense limiting of the invention, which is defined solely in accordance with the following claims.

What is claimed:

1. A foundation vent assembly for controlling ventilation to an enclosed space bounded by a wall of masonry blocks having a rectangular opening therein, said vent assembly comprising: a rigid frame member having a rear wall covering the rear of the opening adjacent the enclosed space, an outwardly turned lower wall engaging blocks at the bottom of the opening, and an outwardly turned upper wall at the top of the opening; vent means formed in said rear wall; a screen member covering said vent means; upwardly projecting surfaces in said lower wall projecting above said lower wall; downwardly projecting surfaces in said upper wall projecting below said upper wall; and vertically extending longitudinally spaced masonry grill blocks supported on said upwardly projecting surfaces and aligned by and located between said downwardly projecting surfaces and providing passages therebetween with said vent means.

2. The foundation vent assembly as recited in claim 1 wherein said vent means includes a plurality of vertical longitudinally spaced slots registering with said passages between said grill blocks.

3. The foundation vent assembly as recited in claim 2 wherein said rear wall includes longitudinal end sections engaging the rears surfaces of blocks at the sides of the opening.

4. The foundation vent assembly as recited in claim 3 wherein said upper wall includes end sections engaging the top surfaces of blocks at the sides and top of said opening.

5. The foundation vent assembly as recited in claim 4 including a closure member on said rear wall and movable between a closed position covering said vent means and an open position providing ventilation to the enclosed space through said vent means.

6. The foundation vent assembly as recited in claim 5 wherein said closure member is pivotally supported about a horizontal axis at an upper end of said rear wall.

7. The foundation vent assembly as recited in claim 6 including manually actuated control means for moving said closure member between said open position and said closed position.

8. The foundation vent assembly as recited in claim 1 wherein said upwardly projecting surfaces in said lower wall comprise longitudinal linear lower tabs, said lower tabs spacing the lower ends of said grill blocks above the blocks therebelow for establishing a lower mortar joint therebetween.

9. The foundation vent assembly as recited in claim 8 wherein said downwardly projecting surfaces in said upper wall comprises spaced transverse upper tabs for aligning the upper ends of the grill blocks.

10. The foundation vent assembly as recited in claim 9 including mortar openings in said upper wall between said upper tabs registering with upper surfaces of said grill blocks for establishing contact with an upper mortar joint across said upper wall.

11. The foundation vent assembly as recited in claim 10 wherein said upper tabs are transversely formed at the sides of said mortar openings.

* * * * *